United States Patent [19]

Hammond

[11] 3,945,646

[45] Mar. 23, 1976

[54] ATHLETIC SWING MEASUREMENT SYSTEM AND METHOD

[75] Inventor: James L. Hammond, Holiday, Fla.

[73] Assignee: Athletic Swing Measurement, Inc., Clearwater, Fla.

[22] Filed: Dec. 23, 1974

[21] Appl. No.: 535,551

[52] U.S. Cl. ..... 273/186 A; 73/493; 73/510; 340/179

[51] Int. Cl.[2] ..... A63B 69/36

[58] Field of Search..... 73/379, 493, 517 R, 510; 273/183 D, 186 A; 340/177 R, 178, 179, 182, 262

[56] References Cited

UNITED STATES PATENTS

| | | | |
|---|---|---|---|
| 2,365,218 | 12/1944 | Rogers | 73/517 R X |
| 2,613,071 | 10/1952 | Hansel | 73/517 R X |
| 3,194,563 | 7/1965 | MacKniesh | 273/186 A |
| 3,270,564 | 9/1966 | Evans | 73/493 X |
| 3,304,787 | 2/1967 | Chiku et al. | 73/517 R |
| 3,815,427 | 6/1974 | Gladstone | 73/493 |
| 3,848,873 | 3/1974 | Linning | 273/186 A |

*Primary Examiner*—James J. Gill
*Attorney, Agent, or Firm*—Duckworth, Hobby & Allen

[57] ABSTRACT

An athletic implement, such as a golf club, has a shaft and a club having a ball-striking face. Multiple accelerometers are positioned in the club so as to measure acceleration in directions normal and parallel to the face and parallel to the shaft, when the implement is swung to strike a ball. Signals representative of acceleration measured in each direction are then transmitted to a remote console where these signals are processed by vector computation to provide indicia representative of the swing, such as club face position, club velocity and acceleration.

9 Claims, 7 Drawing Figures

ATHLETIC SWING MEASUREMENT SYSTEM AND METHOD

BACKGROUND OF THE INVENTION

1. Field of the Invention

This invention relates to measurement systems and methods, and in particular relates to systems and methods wherein the characteristics of motion of an athletic implement are measured and displayed.

2. Description of the Prior Art.

In U.S. Pat. No. 3,270,564 to Evans, there is disclosed a system for measuring three elements of motion (acceleration, torque and flex) of an athletic implement, such as a golf club, during use. In this system, any one or all of these three elements are sensed while the implement is in use and converted to an electrical signal. This signal is transmitted to a nearby console, where it is processed and visually displayed, either as an analog waveform on an oscillograph, or is converted to a digital format for a printout comparison with a reference signal.

Other related systems and techniques are also disclosed in the following U.S. Patents to Evans. In U.S. Pat. No. 3,717,857, a related system is disclosed which may be worn on the athlete's arm. In U.S. Pat. No. 3,788,647 the use of a passive repeater system in the shaft of the club is taught. In U.S. Pat. No. 3,792,863, there is disclosed a multiple swing information storage system, which provides for the simultaneous visual display of several swings for comparison purposes. In U.S. Pat. No. 3,806,131 Evans further discloses means for processing the signal representative of torque and providing a graphic bar display in which the position of each bar indicates the position of the golf club face relative to the plane of flight during incremental periods of the swing.

In each of the above disclosed systems, a single accelerometer is employed in the club head to measure acceleration in a direction normal to the club face.

SUMMARY OF THE INVENTION

The present invention contemplates a measurement system comprising an athletic implement having a shaft and an end portion attached thereto, the end portion having a face which is adapted to strike a ball. First means are provided for sensing an element of motion relative to acceleration of the end portion in one direction, and second means are provided for sensing an element of motion relative to acceleration of the end portion in another direction substantially normal to one direction. In use, electrical outputs representative of the measurements made by the first and second means are processed to provide a visual indication of the measured information.

The present invention further contemplates a method for displaying the position of the face of an end portion of an athletic implement relative to a preselected plane, comprising the steps of measuring acceleration in three directions, each direction being normal to the other directions, one of the directions being normal to the face; and thereafter resolving the acceleration measurements to determine the position of the face.

While the present invention is described in the context of a golf club, it will be appreciated by those skilled in the art that the swing measurement techniques herein disclosed may likewise be utilized with other athletic implements, such as baseball bats, tennis rackets, and the like. Further, the term "athletic implement" is not employed in a limited sense, it being understood that human limbs include a shaft (arm or leg) having an end portion (hand or foot) and also have a face (palm or side of foot) which is adapted to strike a ball.

THE DRAWING

Figure 1:
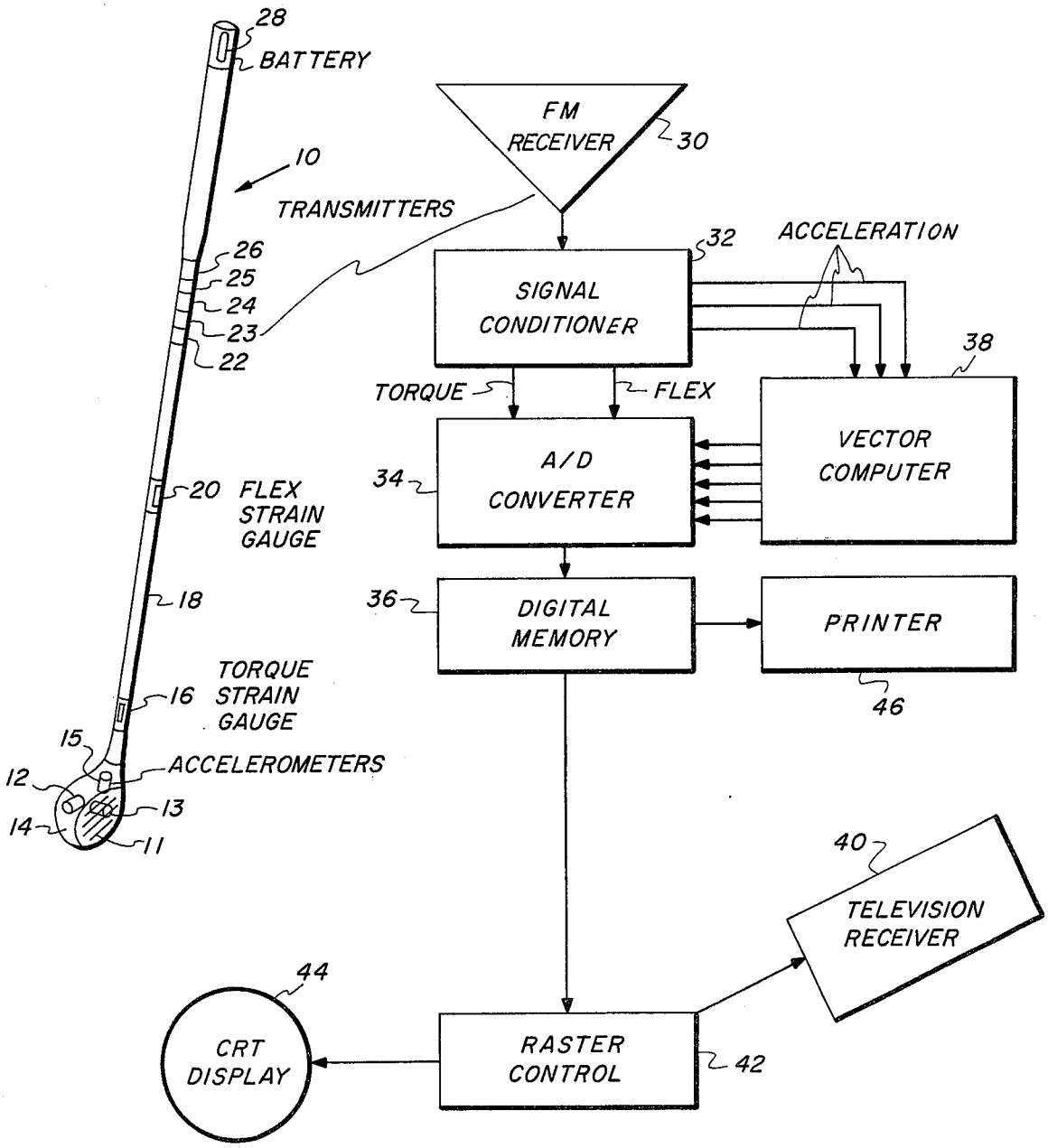
FIG. 1 is an illustration, partially in block diagram form, of an embodiment of a system in accordance with the present invention.
Figures 4A, 4B, 4C, 4D:
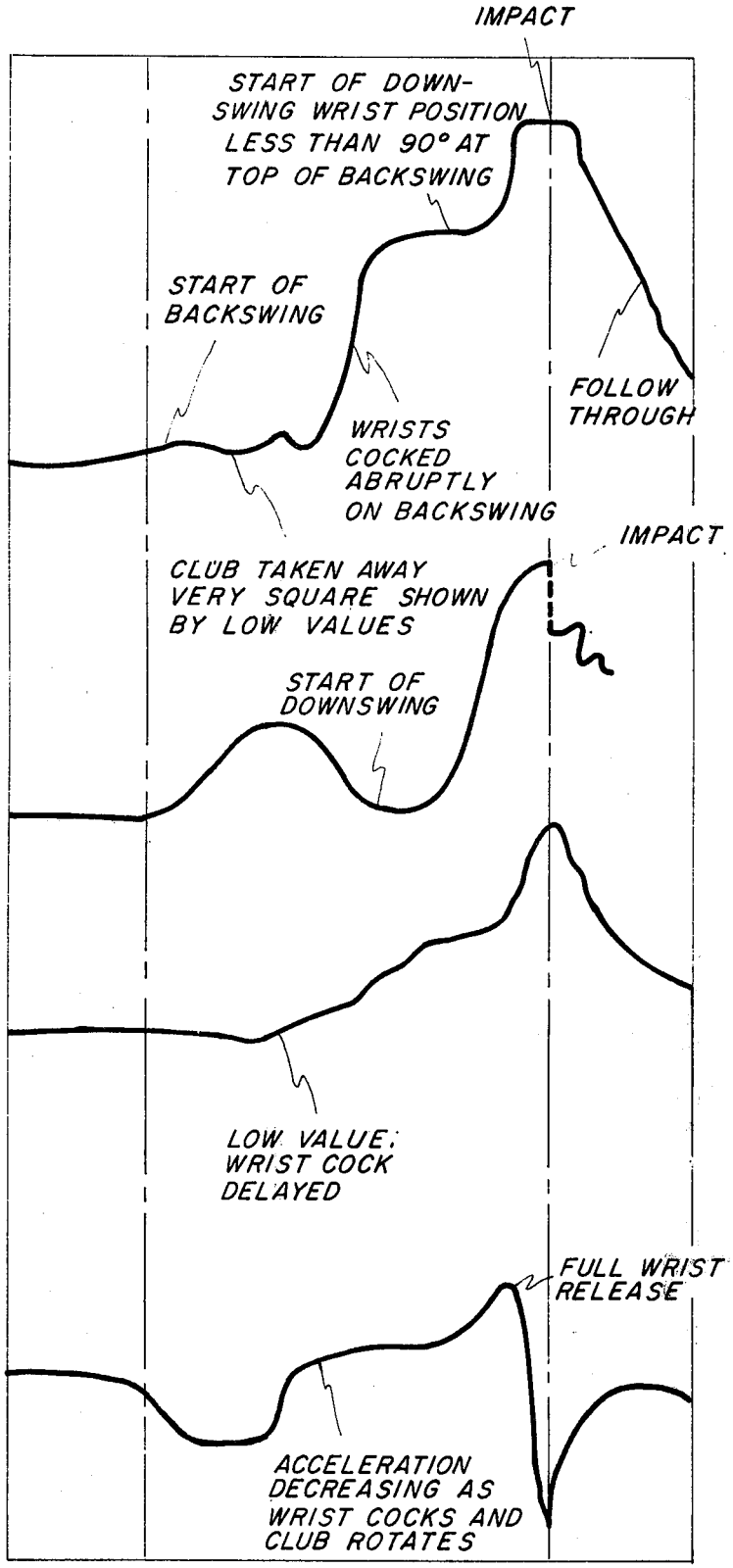

FIGS. 4a, b, c and d are graphic representations of measurements rendered by the system of FIG. 1.

DETAILED DESCRIPTION

An embodiment of the invention is described below with reference to FIGS. 1 and 2. Noting FIG. 1, a golf club, referred to generally as 10, includes a club head 14 and a shaft 18. The club head 14 includes a face 11 which is adapted to strike a golf ball. A torque strain gauge 16 is positioned within the shaft 18 proximal to the club head 14 and is adapted to measure the torque, or angular momentum, about the axis of the shaft 18 during the swing. A flex strain gauge 20 is positioned in an intermediate region of the shaft 18 and is adapted to measure flex, or bending of the shaft during the swing. As described thus far, the instrumental golf club 10 is similar to that disclosed in aforementioned U.S. Pat. No. 3,270,564 to Evans.

Figures 2, 3:
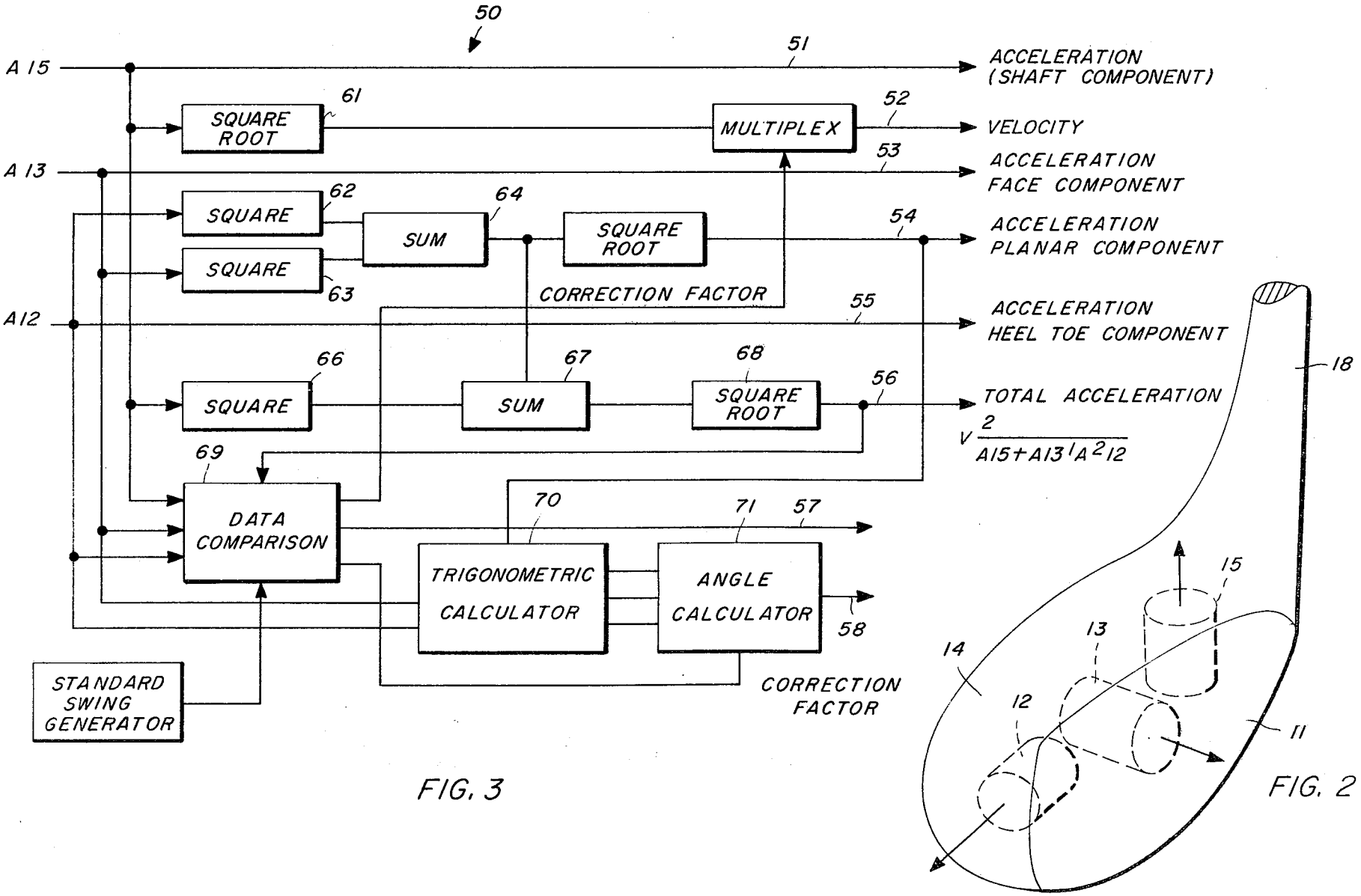
FIG. 2 is a perspective view of a portion of the system of FIG. 1.
FIG. 3 is a block diagram of a portion of the system of FIG. 1.

Reference is now made to FIG. 2. In accordance with the present invention, three accelerometers 12, 13 and 15 are positioned in the club head 14. Each respective accelerometer 12, 13 and 15 are positioned so as to measure acceleration in one of the directions normal to or parallel to the club face 11, or parallel with the shaft 18, each of these directions being substantially normal to the other directions.

The accelerometers 12, 13 and 15 and the torque and flex gauges 16 and 20 are capable of providing an analog electrical output which indicates the magnitude of the corresponding element of motion with respect to time. A variety of accelerometers, torque and flex gauges are commercially available and may be utilized in the present system.

The golf club 10 further comprises means for transmitting the respective outputs of the accelerometers 12, 13 and 15 and the torque and flex gauges 16, 20 to a nearby console for further processing and display as described below in greater detail. The transmission means may comprise, as shown in FIG. 1, five FM transmitters, 22, 23, 24, 25 and 26 which transmit (either on five different frequencies or on a single multiplexed frequency) a signal modulated by the output of the respective accelerometers 12, 13 and 15 and the torque and strain gauges 16 and 20. The shaft 18 serves as a part of a transmitting antenna for the transmitters 22-26. The second conductive part of the antenna may comprise a band of conductive material wrapped under or over the grip (not shown). The accelerometers and gauges 12, 13, 15 and 16 and 20 and the transmitters 22-26 are powered by a voltage source 28, such as a DC battery, which may be located in the upper portion of the shaft 18, or alternatively, in the club head 14.

In an alternate arrangement of the system of FIG. 1, a carrier frequency is transmitted from the nearby console to a passive repeater circuit in the club 10. The carrier is then modulated by the outputs of the accelerometers and gauges and retransmitted to the console for processing and display. This portion of the system is disclosed in the aforementioned U.S. Pat. No. 3,788,647 to Evans, and is therefore omitted here.

The system of FIG. 1 further includes an FM receiver 30 for receiving and demodulating the signals transmitted from the golf club 10. The receiver 30 and other signal and processing and display circuits and components described below may be housed in a record-playback console such as that disclosed in the aforementioned U.S. Pat. No. 3,270,564 to Evans. The outputs of the receiver 30 are fed to a signal conditioning or filter circuit 32 which includes means for discarding noise. The torque and flex outputs of the signal conditioner 32 are fed to an analog-to-digital converter 34, where the analog outputs are translated into a digital format. The three acceleration outputs of the signal conditioner 32 are fed to a vector computer 38, where the various acceleration measurements are processed in a manner hereinafter described below in greater detail with reference to FIG. 3. The outputs of the vector computer 38 are then fed to the analog-to-digital converter 34.

The digital output of the converter 34 is then fed to a memory circuit 36 which serially stores the digital signals representative of the five elements of motion sensed in the golf club 10 by the accelerometers 12, 13 and 15 and the torque and flex gauges 16, 20. Thereafter, these signals may be fed out directly to a printer 46 for display. Further, these signals may be fed to a video-formatting circuit 42 which drives a cathode ray tube 44 to generate analog waveforms depicting the outputs of the torque and flex gauges 16, 20 and the acceleration vectors from the computer 38. Alternatively, the output of the video formatting circuit may be fed directly into a standard television receiver 40.

A preferred embodiment of a circuit comprising the vector calculator 38 is shown in FIG. 3 in block diagram form. The circuit, referred to generally as 50, includes various "building block" circuit arrangements for performing specific mathematical functions in a manner therein shown. The specific combination circuits are notoriously well known in the electronics art, and do not constitute a part of this invention. The circuit 50 is designed to provide three outputs, in this example, which include the basic input signals from the three accelerometers 12, 13 and 15, these respective outputs being correspondingly designated 55, 53 and 51 in FIG. 3. Additionally, a velocity output 52 is provided as an output from a square root circuit 61 which calculates the square root of the output of the accelerometer 15. Another desirable output comprises the planar acceleration component, referred to as output 54 in FIG. 3. This planar acceleration output 54 comprises the square root of the sum of the squares of the outputs of accelerometers 12 and 13, as processed through appropriate square, summing and square root circuits 62, 63, 64 and 65, respectively. Another desirable output constitutes the total acceleration 56 which is the square root of the sum of the squares of the output of the accelerometers 12, 13 and 15, as processed through corresponding square, summing and square root circuits 66, 67 and 68, respectively. The point of impact is detected as an output 57 which is determined from a comparison of the outputs of all three accelerometers 12, 13 and 15 in a data comparison circuit 69. The vector angle 58 is computed by trigometric calculations at appropriate circuits 70, 71 from the outputs of the accelerometers 12, 13, respectively.

The outputs of the accelerometers 12, 13 and 15 are thus processed in the vector computer 38 to provide a variety of information useful for both the fitting of a proper athletic implement to the athlete, as well as for teaching purposes. By computing the vector angle from the acceleration measured by accelerometers 12 and 13, the position of the club face 11 at any instant of time during the swing can be determined. For example, if little or no acceleration is measured by accelerometer 12, while a large value of acceleration is detected by accelerometer 13, it is determined that the forces acting on the club face 11 are primarily in a plane parallel with the direction of measurement of accelerometer 13, and thus parallel with the desired line of flight of the ball; as a result, the club face 11 is normal to that plane, as is desired. A typical trace representative of this angle is shown in FIG. 4a. Alternatively, if a substantial amount of acceleration is measured by accelerometer 12, then the primary force is acting on the club head or out of the plane parallel to the desired line of flight. In this manner, the deviation from the "address" position of the club face 11 (i.e. when presented perpendicular to the line of flight) prior to the swing can be determined. This deviation may be visually displayed as a "tilted bar" series, in the manner described in U.S. Pat. No. 3,806,131 to Evans.

Further, the velocity of the club head 12 can be determined by calculations from the centrifugal acceleration measured by accelerometer 15, or by resolving and combining the acceleration vector between accelerometers 12, 13; alternatively, velocity may be determined by both techniques, and an average velocity measurement determined. A typical velocity trace is shown at FIG. **4*b*. Acceleration toward the heel or toe or toward the club face 11 may also be individually displayed, as is shown respectively in FIGS. 4*c* and 4*d***.

Most importantly, the determination of the impact point (output 57 in FIG. 3) allows subsequent displays and swing comparisons to be made from a common point.

It will be appreciated by those skilled in the art that the above described multiple accelerometer system for measuring the motion components of an athletic implement is highly versatile and provides information useful not only for teaching the athlete, but for selection of the proper implement as well. Further, as noted above, the system and method of the present invention can be employed to make similar measurements of human limbs (arm or leg), and thus is useful in physical therapy and prosthetic device applications.

I claim:

1. A measurement system, comprising:

an athletic implement having a shaft and an end portion attached thereto, said end portion having a face which is adapted to strike a ball along a desired path of flight;

first means mounted with said end portion for sensing an element of motion relative to acceleration of said end portion in one direction substantially parallel with said desired path of flight;

second means mounted with said end portion for sensing an element of motion relative to acceleration of said end portion in another direction substantially parallel with said face; and means for receiving an input from said first and second sensing means and computing an output representative of the instantaneous position of said face relative to a preselected reference plane during movement of said implement.

2. A system as recited in claim 1 wherein said another direction is substantially normal to said one direction.

3. A system as recited in claim 1 further comprising third means for sensing an element of motion relative to acceleration of said end portion in a third direction substantially normal to said one and another directions.

4. A system as recited in claim 1 further comprising a third means for sensing an element of motion relative to acceleration of said end portion in a third direction substantially normal to said one and another directions.

5. Apparatus as recited in claim 1 further comprising means for preselecting said reference plane as the desired plane of flight of said ball.

6. A golf club swing measurement and display system comprising:

a golf club having a shaft and a club attached thereto, said club having a face which is adapted to strike a golf ball;

a first accelerometer positioned in said club so as to measure acceleration in a first direction parallel with said shaft;

a second accelerometer positioned in said club so as to measure acceleration in a second direction normal to said first direction and substantially parallel with the desired line of flight of said ball;

a third accelerometer positioned in said club so as to measure acceleration in a third direction normal to both said first and second directions;

each of said accelerometers including means for providing an electrical signal which varies responsive to the acceleration measured thereby;

means carried by said shaft and coupled to said accelerometer for transmitting an output modulated by said signals;

means for receiving and demodulating said output and reproducing said signals; and means coupled to said receiving and demodulating means for computing vectors from at least two of said signals.

7. A system as recited in claim 6 further comprising:

means for receiving and processing an output from said vector computer and providing signals corresponding thereto; and means for visually representing an output from said receiving and processing means.

8. A method for displaying the position of the ball striking face of the head of a golf club relative to a preselected plane, comprising the steps of:

measuring acceleration of said head in three directions, each direction being substantially normal to the other direction, one of said directions being substantially parallel with said preselected plane;

resolving said acceleration measurements to determine the position of said face and providing an electrical signal corresponding thereto; and processing said signals and providing a visual display thereof.

9. The method as recited in claim 8, further comprising the steps of calculating the point of impact between said face and a ball struck by said face, and employing said calculation results as a reference for said visual displays.

* * * * *